US010676847B2

(12) United States Patent
Melgaard et al.

(10) Patent No.: US 10,676,847 B2
(45) Date of Patent: Jun. 9, 2020

(54) DISCHARGE NOZZLE PLATE FOR CENTER-TO-ENDS FIBER OXIDATION OVEN

(71) Applicant: Despatch Industries Limited Partnership, Lakeville, MN (US)

(72) Inventors: Hans L. Melgaard, North Oaks, MN (US); Daniel M. Ruf, Minneapolis, MN (US); Matthew Benson, Geneva, IL (US); Phillip Vu, St. Louis Park, MN (US)

(73) Assignee: Illinois Tool Works Inc., Glenview, IL (US)

( * ) Notice: Subject to any disclaimer, the term of this patent is extended or adjusted under 35 U.S.C. 154(b) by 71 days.

(21) Appl. No.: 14/923,931

(22) Filed: Oct. 27, 2015

(65) Prior Publication Data

US 2016/0130733 A1 May 12, 2016

Related U.S. Application Data

(60) Provisional application No. 62/076,746, filed on Nov. 7, 2014.

(51) Int. Cl.
*F27B 9/28* (2006.01)
*F27D 7/00* (2006.01)
(Continued)

(52) U.S. Cl.
CPC ..... *D01F 9/32* (2013.01); *D02J 13/001* (2013.01); *F27B 9/28* (2013.01); *F27D 3/00* (2013.01);
(Continued)

(58) Field of Classification Search
CPC .. D01F 9/32; D02J 3/001; F27D 11/00; F27D 2007/023; F27D 3/00; F27D 7/00; F27D 7/02; F27B 9/28
(Continued)

(56) References Cited

U.S. PATENT DOCUMENTS 2,996,138 A 8/1961 Schwartz
3,727,324 A 4/1973 Melgaard
(Continued)

FOREIGN PATENT DOCUMENTS

CN 1484717 3/2004
CN 102782198 11/2012
(Continued)

OTHER PUBLICATIONS

Int'l Search Report and Written Opinion for PCT/US2017/060405 dated Feb. 21, 2018 (15 pgs.).
(Continued)

*Primary Examiner* — Serkan Akar
*Assistant Examiner* — Chris Q Liu
(74) *Attorney, Agent, or Firm* — McAndrews, Held & Malloy, Ltd.

(57) ABSTRACT

One embodiment is directed to an oven for heating fibers. The oven comprises a supply structure disposed within the oven between first and second ends of the oven. The supply structure comprises a plurality of plenums stacked one above each other with gaps therebetween. The plenums are in fluid communication with a heating system. At least one plenum comprises at least one side wall comprising a plurality of passages formed therein, said at least one plenum configured to direct at least a portion of the heated gas into an interior of the oven from the plurality of passages. Each of the plurality of passages formed in said at least one plenum has a respective tapered cross-sectional shape.

8 Claims, 10 Drawing Sheets

(51) Int. Cl.

| | |
|---|---|
| ***F27D 3/00*** | (2006.01) |
| ***F27D 7/02*** | (2006.01) |
| ***F27D 11/00*** | (2006.01) |
| ***D01F 9/32*** | (2006.01) |
| ***D02J 13/00*** | (2006.01) |

(52) U.S. Cl.
CPC ..... *F27D 7/00* (2013.01); *F27D 7/02* (2013.01); *F27D 11/00* (2013.01); *F27D 2007/023* (2013.01)

(58) Field of Classification Search
USPC ..... 219/388, 391, 400; 432/242, 136, 144, 432/190
See application file for complete search history.

(56) References Cited

U.S. PATENT DOCUMENTS

| | | | | |
|---|---|---|---|---|
| 4,032,289 | A | 6/1977 | Johnson et al. | |
| 4,116,612 | A | 9/1978 | Melgaard | |
| 4,208,572 | A | 6/1980 | Melgaard | |
| 4,322,964 | A | 4/1982 | Melgaard et al. | |
| 4,361,744 | A | 11/1982 | Mercier et al. | |
| 4,515,561 | A * | 5/1985 | Melgaard | D02J 13/001 126/21 A |
| 4,729,246 | A | 3/1988 | Melgaard et al. | |
| 4,814,145 | A | 3/1989 | Yoshida | |
| 4,821,866 | A | 4/1989 | Melgaard | |
| 4,846,669 | A | 7/1989 | Melgaard | |
| 4,921,686 | A | 5/1990 | Yoshida | |
| 4,924,073 | A | 5/1990 | Chiba | |
| 4,988,288 | A | 1/1991 | Melgaard | |
| 5,025,775 | A | 6/1991 | Crisp | |
| 5,123,336 | A | 6/1992 | Koenig | |
| 5,263,265 | A | 11/1993 | Melgaard | |
| 5,287,606 | A | 2/1994 | Ruef | |
| 5,295,448 | A | 3/1994 | Vickery | |
| 5,334,818 | A | 8/1994 | Edwards et al. | |
| 5,431,491 | A | 7/1995 | Melgaard et al. | |
| 5,436,569 | A | 7/1995 | Melgaard et al. | |
| 5,446,289 | A | 8/1995 | Shodeen et al. | |
| 5,516,489 | A | 5/1996 | Melgaard et al. | |
| 5,525,295 | A | 6/1996 | Pflug et al. | |
| 5,788,484 | A | 8/1998 | Melgaard et al. | |
| 5,934,178 | A * | 8/1999 | Caridis | A21B 1/245 126/21 A |
| 6,027,337 | A | 2/2000 | Rogers et al. | |
| 6,036,793 | A | 3/2000 | Melgaard et al. | |
| 6,048,493 | A | 4/2000 | Melgaard et al. | |
| 6,129,879 | A * | 10/2000 | Bersted | D02G 3/445 264/211.14 |
| 6,168,743 | B1 * | 1/2001 | Reese | D02J 13/001 264/345 |
| 6,450,086 | B1 | 9/2002 | Martinez Ruiz | |
| 6,455,815 | B1 | 9/2002 | Melgaard et al. | |
| 6,552,560 | B2 | 4/2003 | Melgaard et al. | |
| 6,879,779 | B2 | 4/2005 | Melgaard | |
| 7,514,650 | B2 | 4/2009 | Melgaard et al. | |
| 7,805,064 | B2 | 9/2010 | Ragay et al. | |
| 8,007,276 | B2 | 8/2011 | Melgaard et al. | |
| 8,308,356 | B2 | 11/2012 | Melgaard | |
| 8,895,902 | B2 | 11/2014 | Shei | |
| 2002/0135389 | A1 | 9/2002 | Melgaard et al. | |
| 2002/0146657 | A1 | 10/2002 | Anderson et al. | |
| 2003/0085216 | A1 | 5/2003 | Richert et al. | |
| 2004/0218913 | A1 | 11/2004 | Melgaard | |
| 2006/0079172 | A1 | 4/2006 | Fleming et al. | |
| 2008/0012499 | A1 | 1/2008 | Ragay et al. | |
| 2008/0296283 | A1 | 12/2008 | Melgaard et al. | |
| 2009/0110845 | A1 | 4/2009 | Lu et al. | |
| 2009/0253091 | A1 | 10/2009 | Melgaard et al. | |
| 2009/0260255 | A1 | 10/2009 | Baccini | |
| 2009/0308860 | A1 | 12/2009 | Baccini | |
| 2010/0001087 | A1 * | 1/2010 | Gum | F23N 1/005 237/2 A |
| 2010/0186645 | A1 | 7/2010 | Tiegs | |
| 2010/0267188 | A1 | 10/2010 | Parks et al. | |
| 2011/0188538 | A1 | 8/2011 | Melgaard | |
| 2011/0212010 | A1 | 9/2011 | Bell | |
| 2012/0181265 | A1 | 7/2012 | Menard | |
| 2012/0189968 | A1 | 7/2012 | Warner et al. | |
| 2012/0260518 | A1 | 10/2012 | Melgaard et al. | |
| 2013/0175253 | A1 | 7/2013 | Shei et al. | |
| 2014/0205728 | A1 | 7/2014 | Ploof | |
| 2014/0319118 | A1 | 10/2014 | Melgaard | |

FOREIGN PATENT DOCUMENTS

| | | | |
|---|---|---|---|
| CN | 203168926 | | 9/2013 |
| CN | 103590143 | | 2/2014 |
| CN | 103835010 | | 6/2014 |
| CN | 104081144 | | 10/2014 |
| CN | 104093892 | | 10/2014 |
| EP | 1197148 | | 4/2002 |
| EP | 2738292 | A1 | 6/2014 |
| ES | 2408508 | | 6/2013 |
| GB | 153620 | | 10/1920 |
| JP | 200112870 | | 1/2001 |
| JP | 2008280640 | | 11/2008 |
| NO | 2014176440 | A1 | 10/2014 |
| WO | 2006059387 | | 6/2006 |
| WO | 2009053785 | | 4/2009 |
| WO | 2011098215 | | 8/2011 |
| WO | 2016073815 | | 5/2016 |

OTHER PUBLICATIONS

Seach Report Taiwan Appln. No. 106138584 dated Oct. 11, 2018 (2 pg.).
Seach Report Taiwan Appln. No. 106138584 dated Sep. 20, 2019 (2 pg.).

* cited by examiner

500

532

534

904

1400

DISCHARGE NOZZLE PLATE FOR CENTER-TO-ENDS FIBER OXIDATION OVEN

CROSS-REFERENCE TO RELATED APPLICATION

This application claims the benefit of U.S. Provisional Patent Application Ser. No. 62/076,746, filed Nov. 7, 2014, which is hereby incorporated herein by reference.

BACKGROUND

Oxidation ovens are commonly used to produce carbon fibers from a precursor (such as an acrylic, pitch, or cellulose fibers). One common processing method involves successively drawing fibrous segments of the precursor material through one or more oxidation ovens.

Each of the oxidation ovens comprises a respective oxidation chamber in which the oxidation of the fiber segments takes place. Each fibrous segment can be drawn into a first oxidation oven as a carbon fiber precursor and then make multiple passes through each oxidation oven prior to exiting the final oxidation oven as an oxidized fiber segment. Roll stands and tensioners are used to draw the fibrous segments through the oxidation chambers of the ovens. Each oxidation oven heats the segments to a temperature approaching approximately 300° C. by means of a circulating flow of hot gas.

An example of such an oven is the Despatch Carbon Fiber Oxidation Oven, available from Despatch Industries, Minneapolis, Minn. A description of such an oven can be found in commonly-assigned U.S. Pat. No. 4,515,561. The oven described in the '561 Patent is a "center-to-ends" oxidation oven. In a center-to-ends oxidation oven, hot gas is supplied to the oxidation chamber of the oven from the center of the chamber and flows toward the ends of the chamber.

Typically, such a center-to-ends oxidation oven includes a center supply structure located in the center of the chamber. The center supply structure includes a plurality of supply plenums that are stacked one above each other. Gaps are provided between the stacked supply plenums to enable passage of the fibrous segments between the plenums. Each plenum comprises a duct structure that receives heated air through one or both of its ends. Each plenum includes an array of holes formed in each of the opposing side walls of the corresponding duct structure. This array of holes is also referred to here as a "nozzle." Each plenum is configured to receive heated air and direct the flow of heated gas in approximately horizontal and parallel streams of heated gas out of the nozzles towards both ends of the oxidation chamber.

Such nozzles have typically been formed in a pair of relatively thin metal sheets that form the side walls of the plenum structure. These metal sheets are also referred to here as "nozzle sheets." FIGS. 1-2 illustrate a portion of one example of a conventional nozzle sheet 100 with nozzles 102 formed in the nozzle sheet 100.

The nozzle sheets 100 typically are less than one-quarter inch thick and are made out of aluminum or similar material suitable for use in an oven. The nozzles 102 are typically formed in each nozzle sheet 100 by perforating the sheet.

Given the relative thinness of such nozzle sheets and the large number of nozzles in the sheets, a sheet of hex honeycomb material has typically been layered on the outer surface of each nozzle sheet in order to reinforce the thin nozzle sheets and to help control the angular direction of the air leaving the nozzles so that it leaves the nozzles in more uniform and parallel streams. FIG. 3 illustrates a portion of a sheet 104 of hex honeycomb material, and FIG. 4 illustrates the hex honeycomb material 104 placed on the outer surface of the nozzle sheet 100 shown in FIGS. 1-2.

However, it can be difficult to precisely align the openings in a sheet of hex material with the corresponding nozzles in a thin nozzle sheet. Misalignment of the openings of the hex material with the nozzles in the nozzle sheet can cause the air leaving the nozzles to do so in less uniform and parallel streams. Also, adding two sheets of the hex material to each plenum increases the cost of manufacturing and assembling each plenum.

SUMMARY

One embodiment is directed to an oven for heating fibers. The oven comprises a supply structure disposed within the oven between first and second ends of the oven. The supply structure comprises a plurality of plenums stacked one above each other with gaps therebetween. The plenums are in fluid communication with a heating system. At least one plenum comprises at least one side wall comprising a plurality of passages formed therein, said at least one plenum configured to direct at least a portion of the heated gas into an interior of the oven from the plurality of passages. Each of the plurality of passages formed in said at least one plenum has a respective tapered cross-sectional shape.

Another embodiment is directed to a method of heating fibers using an oven. The method comprises supplying heated gas to a supply structure disposed within an interior of the oven. The supply structure comprises a plurality of plenums stacked one above each other with gaps therebetween. The method further comprises directing at least a portion of the heated gas into the interior of the oven from passages formed in at least one side wall of at least one plenum, said passages having a tapered cross-sectional shape.

DRAWINGS

DETAILED DESCRIPTION

Figure 3:
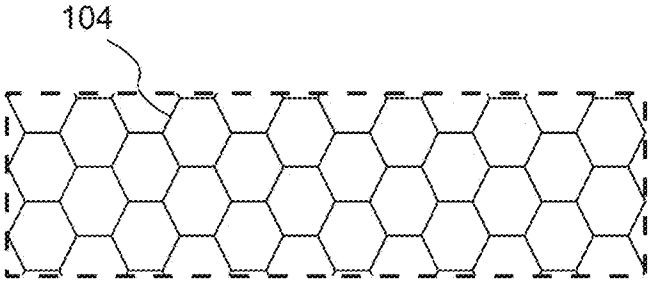
PRIOR ART FIG. 3
FIG. 3 illustrates a portion of a sheet of hex honeycomb material.
Figure 4:
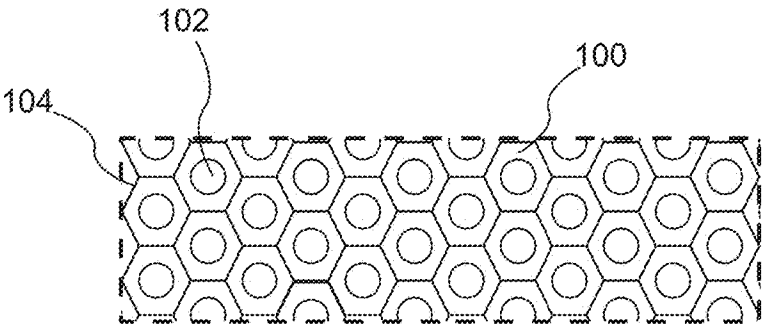
PRIOR ART FIG. 4
FIG. 4 illustrates the hex honeycomb material of FIG. 3 placed on the outer surface of the nozzle sheet shown in FIGS. 1-2.
Figure 1:
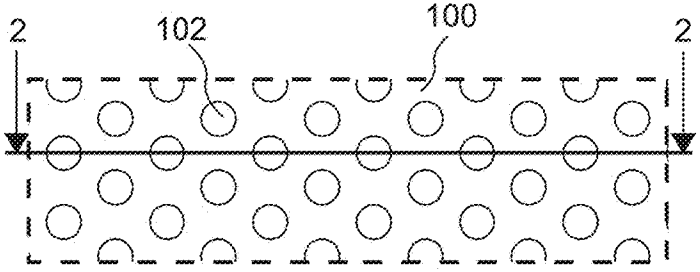
PRIOR ART FIG. 1
FIG. 1 illustrates a portion of one example of a conventional nozzle sheet.
Figure 2:
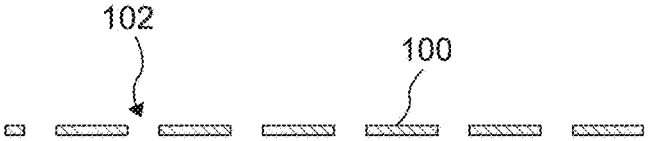
PRIOR ART FIG. 2
FIG. 2 is a cross-sectional view of the nozzle sheet shown FIG. 1.
Figure 5:
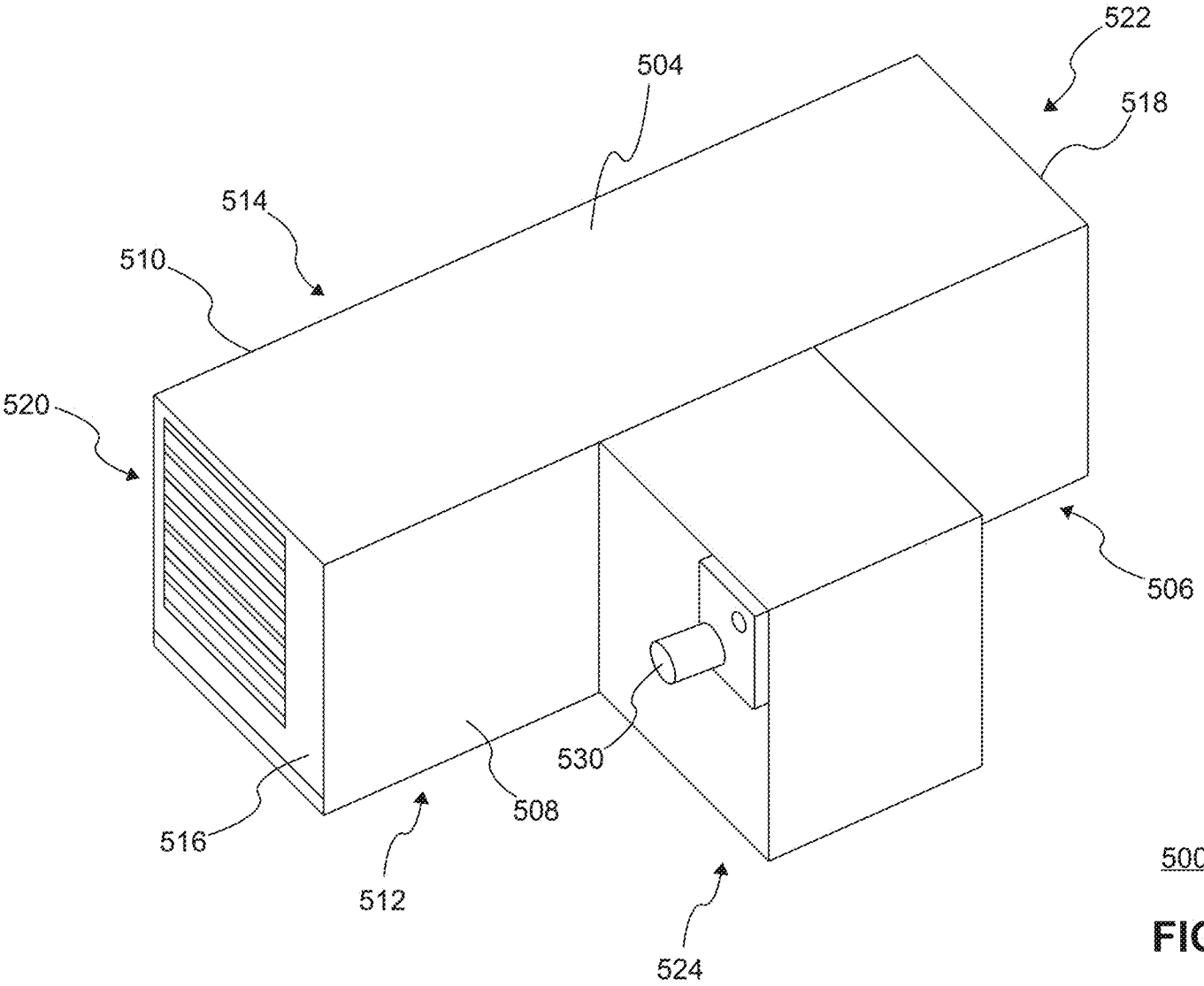
FIG. 5 is a perspective view of one exemplary embodiment of an oven.
Figure 6:
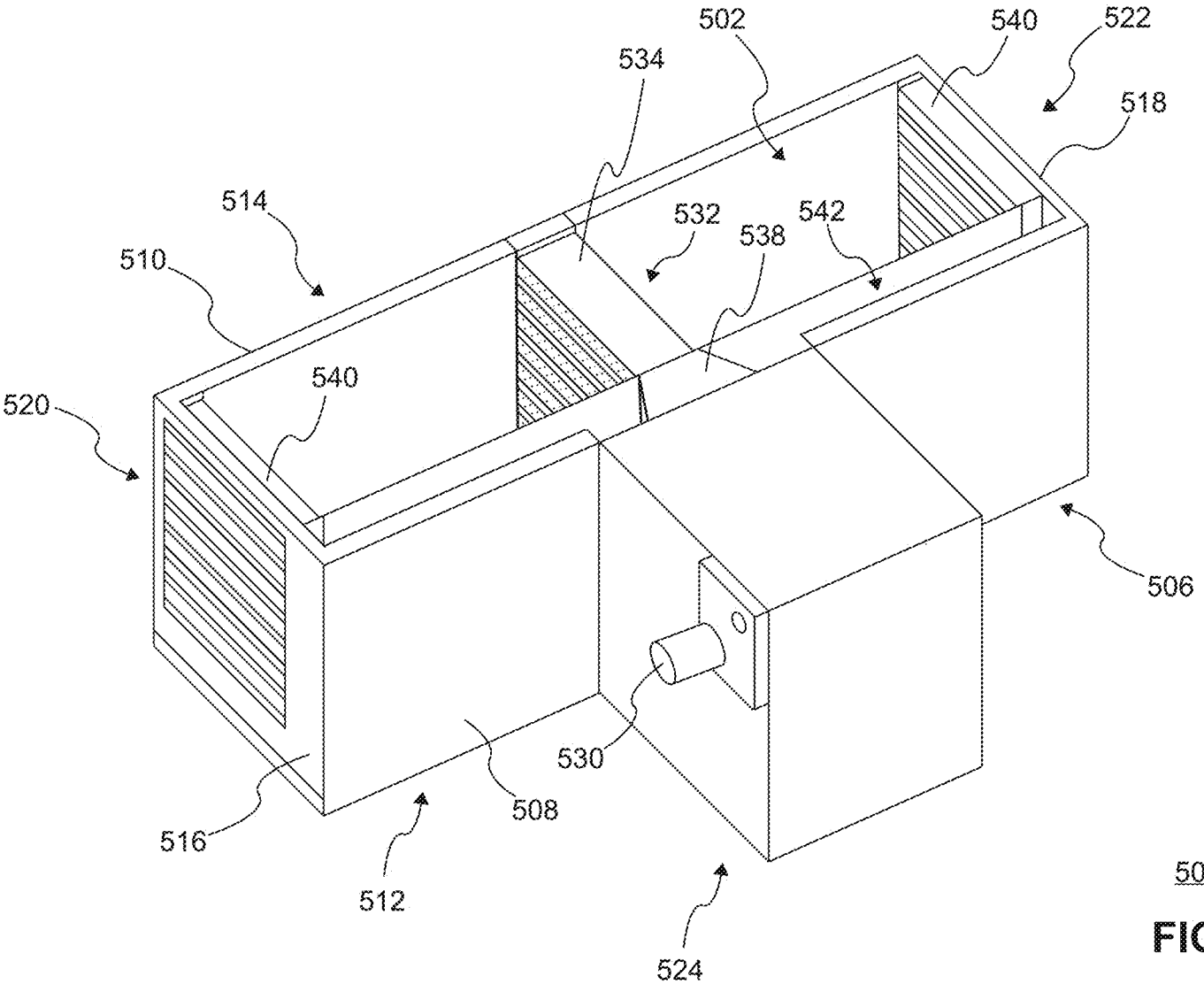
FIG. 6 is a perspective view of the oven shown in FIG. 5 with the top wall removed from the chamber of the oven.
Figure 7:
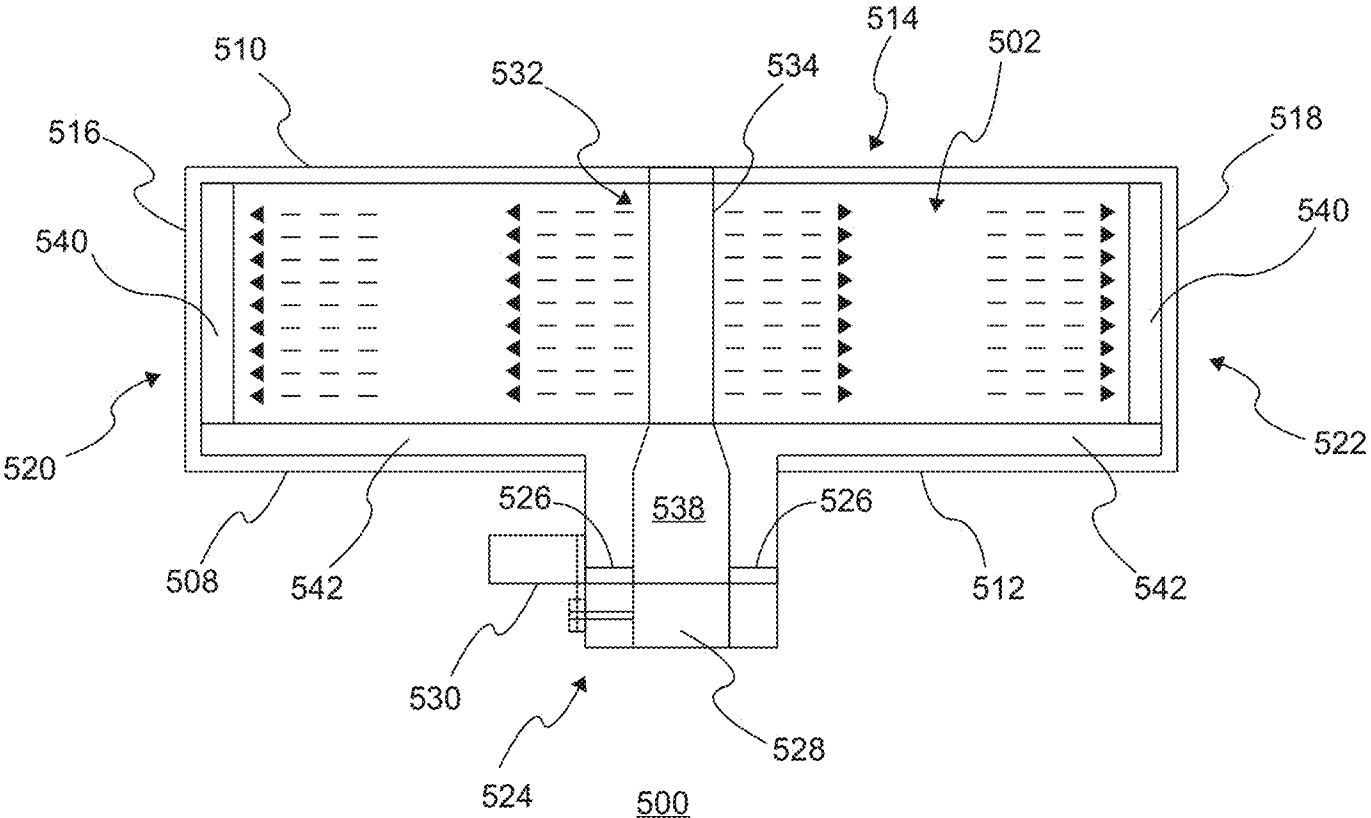
FIG. 7 is a cross-sectional plan view of the oven shown in FIG. 5.

FIGS. 5-7 illustrate one exemplary embodiment of an oxidation oven 500 in which the nozzle plates described below can be used. It is to be understood, however, that the nozzle plates described below can be used in other oxidations ovens.

The oxidation oven 500 shown in FIGS. 5-7 is suitable for use in producing carbon fibers using an oxidation process of the type described above. For example, the exemplary embodiment of an oxidation oven 500 shown in FIGS. 5-7 can be used in oxidation processes that make use of one or multiple ovens (for example, in a stacked configuration) as is known to those of skill in the art.

One of ordinary skill in the art will recognize that, for the sake of brevity and clarity, various conventional features used in oxidation ovens have been omitted from the figures and the following description. Examples of such features include, without limitation, baffles, ducts, vanes, vents, and the like used to adjust the flow of gas within the oven 500, vestibules and exhaust features to reduce the discharge of undesirable processes gases into the ambient environment, and/or insulation, louvers, and other thermal features to improve the thermal efficiency of the oven 500. It is to be understood that the exemplary oven 500 shown in FIGS. 5-7 can include such features In the exemplary embodiment shown in FIGS. 5-7, the oven 500 comprises an oven chamber 502 in which the oxidation of fiber segments take place. In this exemplary embodiment, the oven chamber 502 is defined by a plurality of walls. The walls that define the oxidation chamber 502 include a top wall 504, a bottom wall 506, two side walls 508 and 510 along respective sides 512 and 514 of the chamber 502, and two end walls 516 and 518 at respective ends 520 and 522 of the chamber 502. A respective entry for the fiber is formed in each of the end walls 516 and 518. Each entry is formed by a plurality of slots, which extend between first and second sides 512 and 514 of the chamber 502, and through which the fibrous segments heated by the oxidation oven 500 are drawn. The entries and slots can be formed in a conventional manner.

The oven 500 also comprises a heating system 524. The heating system 524 is used to supply heated gas into the chamber 502. In this exemplary embodiment, the gas that is used is ambient air.

The heating system 524 can be implemented in various ways. In the exemplary embodiment shown in FIGS. 5-7, the heating systems 524 is implemented using at least one heater 526 (shown in FIG. 7), a blower 528 (shown in FIG. 7) to draw gas through the heater 526, and a motor 530 to power the blower 528. Each heater 526 can be implemented in various ways. For example, each heater 526 can be implemented using one or more heating elements. Also, each heater 526 can be implemented using an indirect gas heater, an electric heater, or combinations thereof. Each heater 526 can be implemented in other ways.

The heating system 524 can be controlled, for example, using one or more suitable controllers (such as proportional-integral-derivative (PID) controllers).

The oven 500 includes a supply structure 532 disposed within the interior of the chamber 502 between the ends 520 and 522 of the chamber 502. In the exemplary embodiment shown in FIGS. 5-7, the oven 500 is a center-to-ends oxidation oven in which heated gas is supplied from the center of the oxidation chamber 502 towards the ends 520 and 522 of the chamber 502. In this exemplary embodiment, the supply structure 532 is disposed within the interior of the chamber 502 at or near the center of the chamber 502 between the ends 502 and 522 and is also referred to here as the "center supply structure" 532.

In the exemplary embodiment shown in FIGS. 5-7, the center supply structure 532 comprises a plurality of supply plenums 534 that are stacked one above each other with gaps therebetween.

Figure 8:
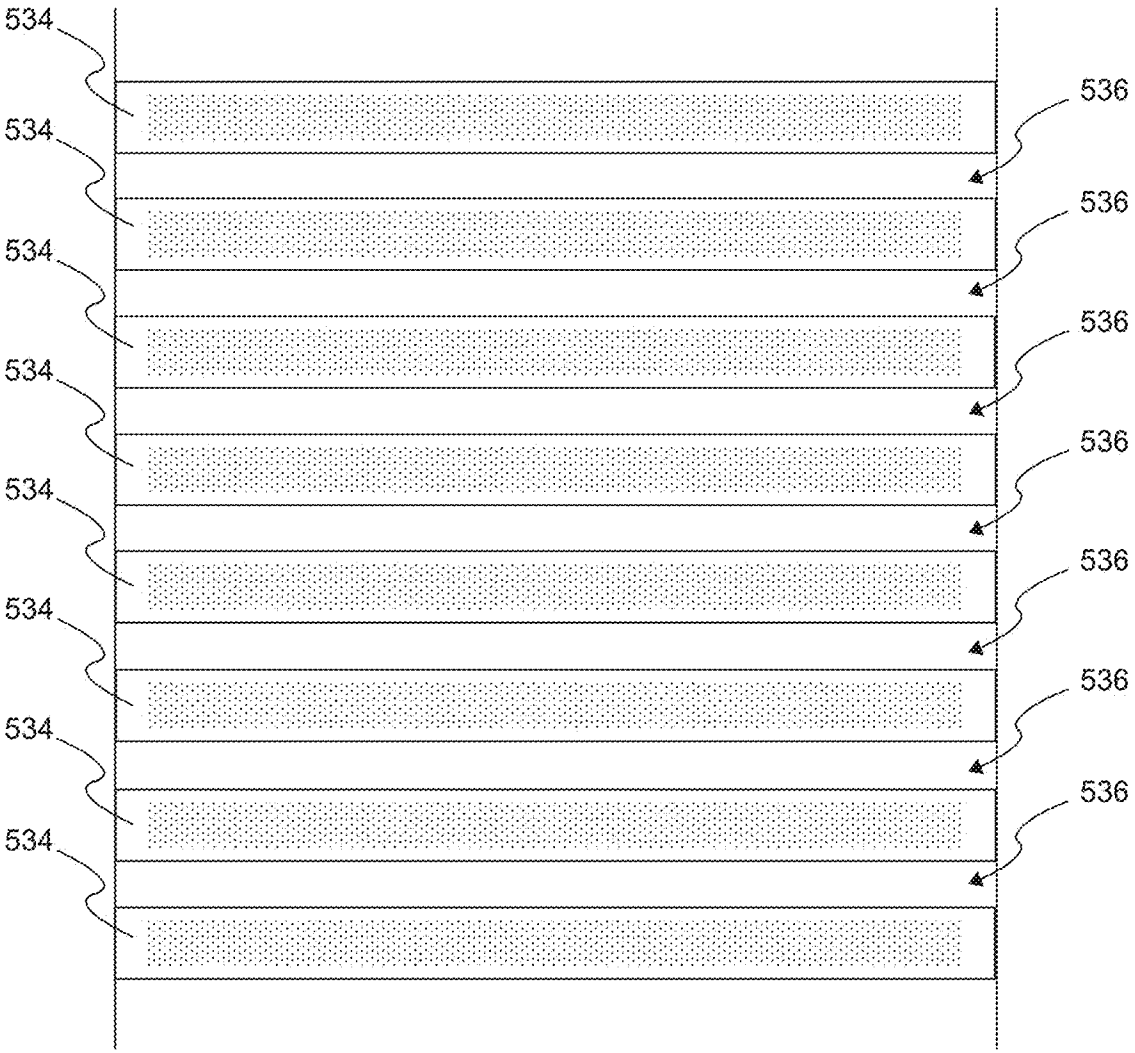
FIG. 8 is illustrates details of the center supply structure of the oven shown in FIG. 5.

The center supply structure 532 is shown in more detail in FIG. 8. Gaps 536 (shown in FIG. 8) are provided between the stacked supply plenums 534 to enable passage of the fibrous segments between the plenums 534.

More details regarding the supply plenums 534 are provided below in connection with the description of FIGS. 9-13.

The plenums 534 are in fluid communication at one or both of their ends with a supply duct 538 (shown in FIGS. 6 and 7) in order to receive heated gas from the heating system 524. In the exemplary embodiment shown in FIGS. 5-7, each plenum 534 is configured to receive heated air through one of its ends (though it is to be understood that in other embodiments, each plenum receives heated air through both of its ends).

The supply duct 538 can be appropriately tapered or provided with adjustable slots or other features (not shown) to adjust the flow heated gas so that the velocity of heated gases exiting the plenums 534 is substantially uniform.

Each oven 500 also includes two return structures 540 within the oxidation chamber 502. One return structure 540 is positioned near the first end wall 516, and the other return structure 540 is positioned near the second end wall 518. Each of the return structures 540 includes a plurality of return channels that are each stacked one above another and that are positioned to generally correspond with the positions of corresponding plenums 534 of the center supply structure 532. Gaps are provided between the return channels to enable passage of fibrous segments between the return channels.

The return channels of each return structure 540 are configured to receive at least a portion of the gas directed from the center supply structure 532 toward that return structure 540. That is, each return structure 540 receives gas directed from one side of the plenums 534 in the center supply structure 532 toward that return structure 540.

A return duct 542 is used to establish fluid communication between each return structure 540 and the heating system 524. In this way, at least a portion of the heated gas received by the return structures 540 is directed back to the heating system 524 to be heated and supplied to the plenums 534 via the supply ducts 538 as described above.

In the exemplary embodiment shown in FIGS. 5-7, the return ducts 542 are located within the walls of the chamber 502. However, it is to be understood that the return ducts 542 can be implemented in other ways (for example, by positioning at least a portion of the return ducts 542 outside of the walls of the chamber 502).

In the exemplary embodiment described here in connection with FIGS. 5-7, each of the plenums 534 is implemented as shown in FIGS. 9-13. Each plenum 534 is supplied with heated gas at a first end 900 of the plenum 534. The heated gas is supplied from a supply duct 538.

Figure 10:
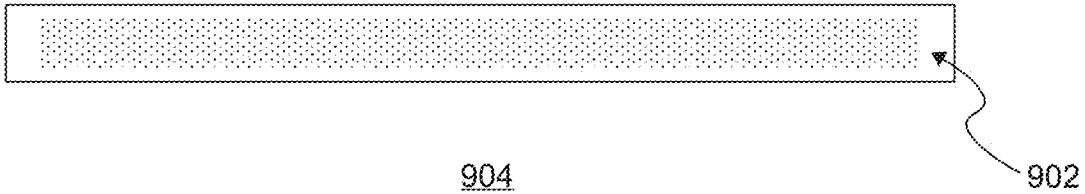
FIG. 10 is a side view of one side wall of the supply plenum shown in FIG. 9.

Each plenum 534 is generally rectangular in cross section and extends horizontally between, but spaced from the side walls 508 and 510 of the chamber 502. As shown in FIG. 10, each plenum 534 has passages 902 formed in the side walls 904 of the plenum 534. These passages 902 are also referred to here as the "nozzles" 902. In this exemplary embodiment, each side wall 904 of each plenum 534 is implemented using a plate as described below in more detail in connection with FIGS. 10-12 (and these plates are also referred to here as "nozzle plates" 904).

The passage formed in the nozzle plate 904 for each nozzle 902 has an inlet opening 908 (shown in FIGS. 12-13) into which air supplied to the plenum 534 enters and has an outlet opening 910 (shown in FIGS. 12-13) from which the supplied air exits and is discharged into the chamber 502 of the oven 500. The outlet openings 910 for the nozzles 902 face the respective ends 520 and 522 of the chamber 502.

The nozzles 902 extend across the width of the plenum 534. The nozzles 902 are constructed and arranged so as to direct the flow of the received heated gas in approximately horizontal and parallel streams of heated gas toward the ends 520 and 522 of the oxidation chamber 502. The streams of gas are directed alongside each fibrous segment that traverses that portion of the oxidation chamber 502.

Figure 9:
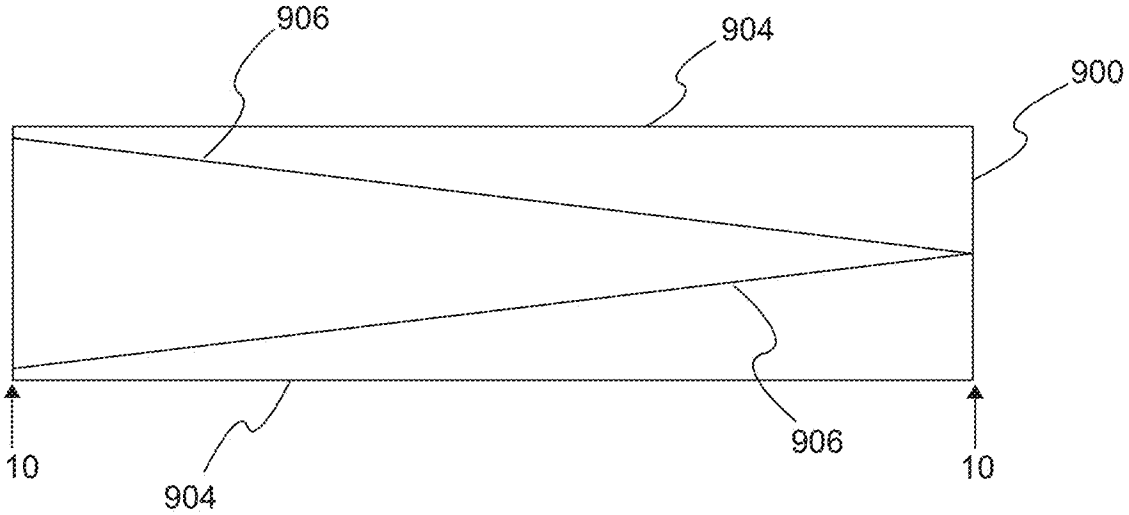
FIG. 9 is a cross-sectional plan view of one exemplary embodiment of a supply plenum.

Each plenum 534 includes one or more baffles 906 that are disposed within the interior of the plenum 534 between the nozzle plates 904 of the plenum 534. In this exemplary embodiment, the baffles 906 are arranged in a V-shape as shown in FIG. 9, with the tip portion of the V-shape located near the end 900 where heated gas is supplied to the plenum 534. This V-shaped arrangement of the baffles 906 is generally designed to direct the flow of the received heated gas out of the nozzles 902 in a uniform manner.

Figure 11:
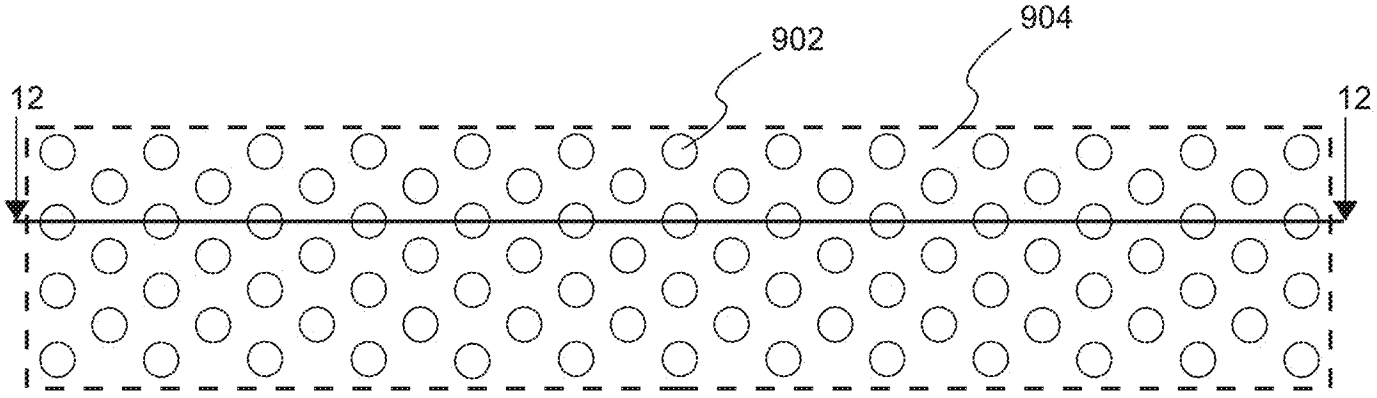
FIG. 11 illustrates a portion of the side wall shown in FIG. 10 in more detail.
Figure 12:
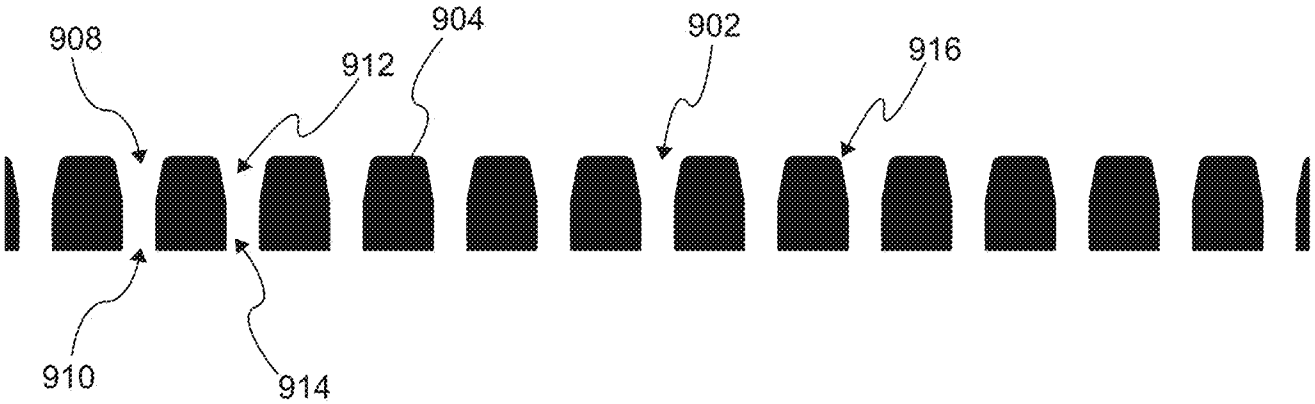
FIG. 12 is a cross-sectional view of the portion of the side wall shown in FIG. 11.
Figure 13:
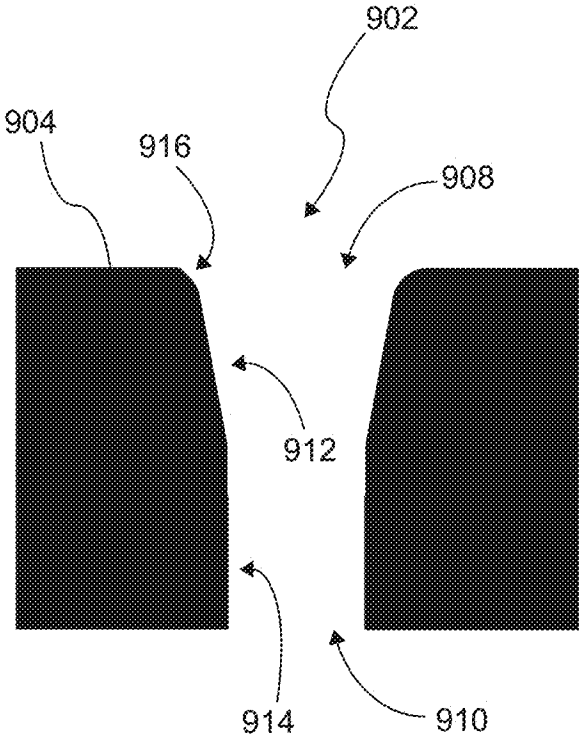
FIG. 13 is a detailed view of one of the nozzles shown in FIG. 12.

FIG. 10 illustrates the nozzles 902 formed in one of the nozzle plates 904 of the plenum 534. In this exemplary embodiment, the nozzles 502 are formed in both nozzle plates 904 the same way (though only the nozzles 902 for one of the nozzle plates 904 are shown). FIG. 11 illustrates a portion of the nozzle plate 904 shown in FIG. 10 in more detail. FIG. 12 is a cross-sectional view of the portion of the nozzle plate 904 shown in FIG. 11. FIG. 13 is a detailed view of one of the nozzles 902 shown in FIG. 12.

The nozzles 902 can be formed in the nozzle plates 904, for example, by drilling and machining the passages for the nozzles 902 and/or by using a casting process to produce the nozzle plates 904 with the passages for the nozzles 902 formed in the nozzle plates 904. The nozzles 902 can be formed in the nozzle plates 904 in other ways.

As shown in FIG. 12, in this exemplary embodiment the nozzle plate 904 is much thicker than conventional perforated nozzle sheets. For example, the nozzle plate 904 can have a thickness that is greater than 0.25 inches. The nozzle plate 904 can be made out of aluminum or similar material suitable for use in an oven.

Also, each nozzle 902 is formed in the nozzle plate 904 with a round opening (shown in FIG. 11) and with a tapered cross-sectional shape (shown in FIGS. 12-13). The tapered cross-sectional shape of each nozzle 902 has an inlet opening 908 that is larger than the corresponding outlet opening 910 of each nozzle 902.

In this exemplary embodiment, the tapered cross-sectional shape for each nozzle 902 comprises a tapered section 912 that extends from the inlet opening 908 of the nozzle 902 for at least a portion of the width of the nozzle plate 904. Each nozzle 902 also includes a straight section 914 that extends from the end of the tapered section 912 to the outlet opening 910 of that nozzle 904.

Air supplied to each plenum 534 would tend to travel parallel to the side walls 904 of the plenum 534. However, the air interacts with the baffle 906 as it passes through the plenum 534 and, as a result, at least a portion of the air is directed into the inlet opening 908 of each nozzle 902 as the air passes across the plenum 534.

In this exemplary embodiment, the tapered section 912 of each nozzle 902 has a curved or beveled edge 916 along the inlet opening 908. The curved or beveled edge 916 helps enable air that is flowing past the nozzle 902 to enter that nozzle 902. The tapered section 912 of each nozzle gradually re-directs the air that enters the nozzle 902, whereas the straight section 914 of each nozzle 902 stabilizes and aligns the air so that it flows out of the outlet opening 910 of the nozzle 902 in uniform streams.

By not using such sheets of hex honeycomb material, the difficult task of precisely aligning the openings in each sheet of hex material with the corresponding nozzles in the thin perforated nozzle sheet can be avoided, as well as the problems that can arise from any such misalignment. Also, the costs of manufacturing and assembling each plenum 534 can be reduced by not adding two sheets of hex honeycomb material to the plenum 534.

Moreover, the tapered cross-sectional shape of the nozzles 902, combined with the thicker nozzle plate 904, helps the air leaving the nozzles 902 to do so in more uniform and parallel streams of air, without using the sheets of hex honeycomb material Furthermore, by not using perforated sheets, the same degree of uniformity in the resulting air streams can be achieved with a reduced static pressure.

Also, by not using sheets of hex honeycomb material, the shape and arrangement of the outlet openings 910 of the nozzles 902 do not have to accommodate the openings in a hex honeycomb material layered over the nozzle plate 904.

Figure 14:
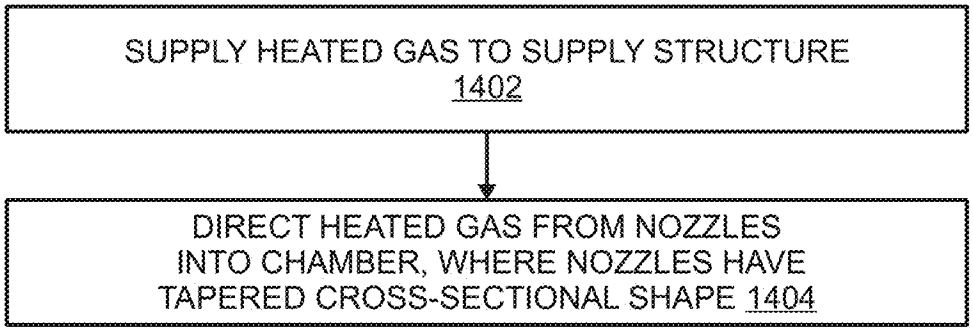
FIG. 14 is a flow diagram of an exemplary embodiment of a method of heating fibers by contact with heated gas.

FIG. 14 is a flow diagram of an exemplary embodiment of a method 1400 of heating fibers by contact with heated gas. The embodiment of method 1400 shown in FIG. 14 is described here as being implemented using the exemplary embodiment of an oxidation oven 500 and nozzle plate 904 described above in connection with FIGS. 5-13. However, it is to be understood that other embodiments can be implemented in other ways.

Method 1400 comprises supplying heated gas to the supply structure 532 disposed within the interior of the oven 500, where the supply structure 532 comprises a plurality of plenums 534 stacked one above each other with gaps 536 therebetween (block 1402). In this exemplary embodiment, the heated gas is supplied from the heating system 528 to each plenum 534 via the supply duct 538.

Method 1400 further comprises directing at least a portion of the heated gas into the interior of the oven 502 from nozzles 902 formed in at least one side wall 904 of at least one of the plenums 534, where said nozzles 902 have a tapered cross-sectional shape (block 1404). The heated gas flows out of the nozzles 902 in approximately horizontal and parallel streams of heated gas toward the ends 520 and 522 of the oxidation chamber 502 alongside each fibrous segment that traverses that portion of the oxidation chamber 502.

In this exemplary embodiment, at least a portion of the heated gas is directed into inlet openings 908 of the nozzles 902 and at least a portion of the heated gas is directed into the interior of the oven 500 from outlet openings 910 of the nozzles 902. Also, in this example, at least a portion of the heated gas that is directed into the inlet openings 908 of the nozzles 902 is directed along the curved or beveled edges 916 formed along the inlet openings 908 and into tapered sections 912 of the nozzles 902. Moreover, in this example, at least a portion of the heated gas that is directed into the interior of the oven 500 from outlet openings 910 of the nozzles 902 is directed into straight sections 914 of the nozzles 902 prior to being discharged into the interior of the oven 500.

The embodiments described above are merely exemplary and are not intended to be limiting.

Figure 15:
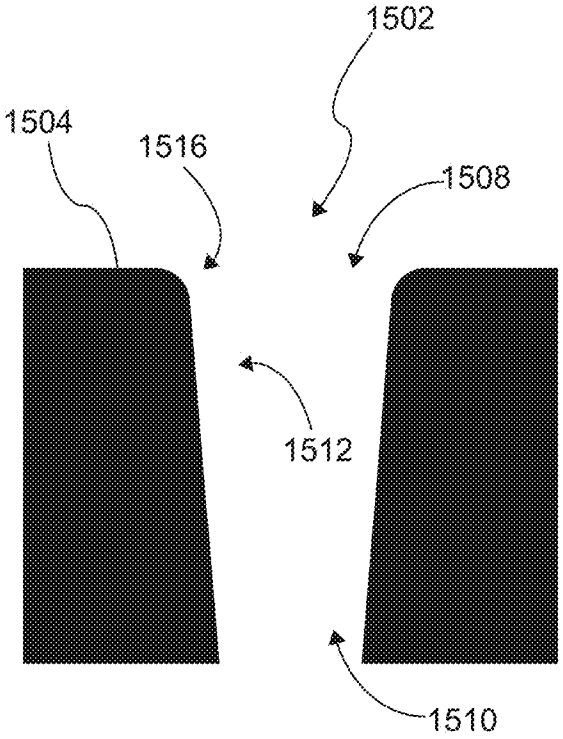
FIG. 15 illustrates one alternative tapered cross-sectional nozzle shape.

It is to be understood that the tapered cross-sectional shape of the nozzles 902 can be implemented in other ways. FIG. 15 illustrates one alternative tapered cross-sectional shape of nozzle 1502 that can be used in the plenum 534 described above. The nozzle 1502 is generally the same as the nozzle 902 described above in connection with FIGS. 9-13 except as described below.

In this example embodiment, the tapered section 1512 of the nozzle 1502 extends from the inlet opening 1508 of the nozzle 1502 to the outlet opening 1510 of the nozzle 1502 and does not include a straight section. Also, as with the embodiment described above in connection with FIGS. 9-14, the tapered section 1512 of each nozzle 1502 has a curved or beveled edge 1516 along the inlet opening 1508.

Other tapered cross-sectional shapes can be used.

In the exemplary embodiments described above, each plenum 534 is supplied with heated gas from a single side. However, in other embodiments, the plenums in the center supply structure are supplied with gas from both sides.

Moreover, in the example embodiments described above, the cross-sectional shapes of all nozzles are the same. However, in other embodiments, this is not the case and the size and shapes of the nozzles can vary from nozzle to nozzle within a given plenum and can vary from plenum to plenum within a given supply structure. Also, in the example embodiments described above, each plenum is shown as having two sides walls where both sides walls have nozzles formed therein with a tapered cross-sectional shape as described above. However, this need not be the case (for example, only one of the side walls can have nozzles formed therein with a tapered cross-sectional shape as described above). Furthermore, in the exemplary embodiments described above, each plenum in the center supply structure has the same configuration and design. However, this need not be the case and, instead, one or more plenums included in the center supply structure can have configurations and/or designs that differ from one or more other plenums included in the center supply structure.

A number of embodiments have been described. Nevertheless, it will be understood that various modifications to the described embodiments may be made without departing from the spirit and scope of the claimed invention.

Example Embodiments

Example 1 includes an oven for heating fibers, the oven comprising: a supply structure disposed within the oven between first and second ends of the oven, the supply structure comprising a plurality of plenums stacked one above each other with gaps therebetween, wherein the plenums are in fluid communication with a heating system; wherein at least one plenum comprises at least one side wall comprising a plurality of passages formed therein, said at least one plenum configured to direct at least a portion of the heated gas into an interior of the oven from the plurality of passages; and wherein each of the plurality of passages formed in said at least one plenum has a respective tapered cross-sectional shape.

Example 2 includes the oven of Example 1, wherein each of the passages formed in said at least one side wall of said at least one plenum comprises a respective inlet opening and a respective outlet opening.

Example 3 includes the oven of Example 2, wherein, for at least one of the passages, the respective inlet opening is larger than the respective outlet opening.

Example 4 includes the oven of any of Examples 2-3, wherein at least one of the passages formed in said at least one side wall of said at least one plenum comprises a tapered section extending from the respective inlet opening.

Example 5 includes the oven of Example 4, wherein said at least one of the passages comprising the tapered section further comprises a curved or beveled edge along the respective inlet opening.

Example 6 includes the oven of any of Examples 2-5, wherein at least one of the passages formed in said at least one side wall of said at least one plenum comprises a tapered section extending from the respective inlet opening and a straight section extending from an end of the tapered section to the respective outlet opening.

Example 7 includes the oven of any of Examples 1-6, wherein honeycomb material is not placed on an outer surface of said at least one plenum.

Example 8 includes the oven of any of Examples 1-7, wherein said at least one side wall is at least 0.25 inches thick.

Example 9 includes a method of heating fibers using an oven, the method comprising: supplying heated gas to a supply structure disposed within an interior of the oven, the supply structure comprising a plurality of plenums stacked one above each other with gaps therebetween; and directing at least a portion of the heated gas into the interior of the oven from passages formed in at least one side wall of at least one plenum, said passages having a tapered cross-sectional shape.

Example 10 includes the method of Example 9, wherein directing at least a portion of the heated gas into the interior of the oven from said passages comprises: directing at least a portion of the heated gas into inlet openings of said passages; and directing at least a portion of the heated gas into the interior of the oven from outlet openings of said passages.

Example 11 includes the method of Example 10, wherein, for at least one of said passages, the respective inlet opening is larger than the respective outlet opening.

Example 12 includes the method of any of Examples 10-11, wherein at least one of said passages comprises a tapered section extending from the respective inlet opening.

Example 13 includes the method of any of Examples 10-12, wherein directing at least a portion of the heated gas into inlet openings of said passages comprises: directing at least a portion of the heated gas along curved or beveled edges formed along inlet openings of said passages.

Example 14 includes the method of any of Examples 10-13, wherein directing at least a portion of the heated gas into inlet openings of said passages comprises: directing at least a portion of the heated gas into tapered sections of said passages.

Example 15 includes the method of any of Examples 10-14, wherein directing at least a portion of the heated gas into the interior of the oven from outlet openings of said passages comprises: directing at least a portion of the heated gas into straight sections of said passages prior to discharging the heated gas into the interior of the oven.

What is claimed is:

1. An oven for heating fibers, the oven comprising:

a supply structure disposed within the oven between first and second ends of the oven, the supply structure comprising a plurality of plenums stacked one above each other with gaps therebetween, wherein the plurality of plenums are in fluid communication with a heating system;

wherein at least one plenum of the plurality of plenums comprises at least one side wall comprising a plurality of passages formed therein, said at least one plenum configured to direct at least a portion of a heated gas into an interior of the oven from the plurality of passages; and wherein each of the plurality of passages formed in said at least one side wall has a single inlet opening corresponding to a single outlet opening of the passage, and each of the plurality of passages comprises:

a tapered portion adjacent the single inlet opening of the passage to re-direct the heated gas that enters the passage; and a straight portion between the tapered portion and the single outlet opening of the passage to stabilize and align the heated gas.

2. The oven of claim 1, wherein, for at least one of the plurality of passages, the respective inlet opening is larger than the respective outlet opening.

3. The oven of claim 1, wherein at least one of the plurality of passages formed in said at least one side wall of said at least one plenum comprises a tapered section extending from the respective inlet opening.

4. The oven of claim 3, wherein said at least one of the plurality of passages comprising the tapered section further comprises a curved or beveled edge along the respective inlet opening.

5. The oven of claim 1, wherein honeycomb material is not placed on an outer surface of said at least one plenum.

6. The oven of claim 1, wherein said at least one side wall is at least 0.25 inches thick.

7. The oven of claim 1, wherein every one of the plurality of passages formed in said at least one side wall is tapered between the inlet opening and the corresponding outlet opening of the passage.

8. The oven of claim 1, further comprising one or more baffles within respective interiors of the plurality of plenums and configured to direct the heated gas out of the respective passages in a uniform manner.

* * * * *